US005735433A

United States Patent [19]

Power

[11] Patent Number: 5,735,433

[45] Date of Patent: Apr. 7, 1998

[54] APPARATUS FOR DISPENSING SLICED BREAD

[76] Inventor: Andrew Harold Power, 79 Bridge Street, Toowoomba, Queensland, 4350, Australia

[21] Appl. No.: 737,918

[22] PCT Filed: May 23, 1995

[86] PCT No.: PCT/AU95/00298

§ 371 Date: Nov. 22, 1996

§ 102(e) Date: Nov. 22, 1996

[87] PCT Pub. No.: WO95/31921

PCT Pub. Date: Nov. 30, 1995

[30] Foreign Application Priority Data

May 23, 1994 [AU] Australia ..... PM5785

[51] Int. Cl.[6] ..... A47G 19/32; A47J 47/01

[52] U.S. Cl. ..... 221/229; 221/226; 221/256; 221/289; 221/296; 221/279

[58] Field of Search ..... 221/226, 229, 221/236, 246, 255, 256, 279, 289, 290, 292, 296, 266

[56] References Cited

U.S. PATENT DOCUMENTS

| | | | |
|---|---|---|---|
| 633,006 | 9/1899 | Hufeland . | |
| 847,863 | 3/1907 | Watts . | |
| 1,234,296 | 7/1917 | Cutler . | |
| 1,248,823 | 12/1917 | Cutler . | |
| 1,418,153 | 5/1922 | Lorber . | |
| 2,291,187 | 7/1942 | Johnson | 221/256 |
| 2,426,999 | 9/1947 | Hilton et al. . | |
| 2,595,481 | 5/1952 | Palmos . | |
| 2,630,913 | 3/1953 | Goodkowitz . | |
| 2,819,819 | 1/1958 | Warren . | |
| 3,151,920 | 10/1964 | Burrell . | |
| 3,161,320 | 12/1964 | Swanson . | |
| 3,298,568 | 1/1967 | Le Brocq . | |
| 3,326,413 | 6/1967 | Anderson . | |
| 3,578,207 | 5/1971 | Danow . | |
| 3,833,148 | 9/1974 | Honas . | |
| 3,923,200 | 12/1975 | Miller . | |
| 4,000,831 | 1/1977 | House . | |
| 4,213,540 | 7/1980 | Stanford . | |
| 4,320,932 | 3/1982 | Giffin . | |
| 4,500,145 | 2/1985 | Fassauer . | |
| 4,905,869 | 3/1990 | Grigsby et al. . | |
| 5,191,996 | 3/1993 | Jenkins | 221/279 |
| 5,328,258 | 7/1994 | Scalise . | |

FOREIGN PATENT DOCUMENTS

| | | |
|---|---|---|
| 24002 | 8/1984 | Australia . |
| 167465 | 5/1934 | France . |
| 295129 | 6/1916 | Germany . |
| 3631828 | 4/1987 | Germany . |
| 412567 | 1/1946 | Italy . |
| 1097547 | 12/1981 | U.S.S.R. . |

*Primary Examiner*—H. Grant Skaggs
*Attorney, Agent, or Firm*—Panitch Schwarze Jacobs & Nadel, P.C.

[57] ABSTRACT

A bread dispensing apparatus has a rigid hollow body (10) in which bread slices can be placed, an upper inlet (11), a lower outlet (14) which is associated with a pull down dispenser. When the dispenser is pulled down, bread can be removed from the body. Hold back blades are provided to allow only the desired number of pieces of bread to be dispensed, the hold back blades being connected to the dispenser such that pulling down of the dispenser operates the hold back blades.

15 Claims, 7 Drawing Sheets

APPARATUS FOR DISPENSING SLICED BREAD

TECHNICAL FIELD

This invention relates to an apparatus for dispensing sliced bread and is particularly directed to a simple to use apparatus which can keep bread fresh, which provides for hygienic dispensing of bread and which can be used in kitchens, food outlets and the like.

BACKGROUND ART

Bread products are consumed by the majority of the population on a daily basis. These bread products, if left open to the atmosphere go stale. This is not desirable. Both paper and plastic bags have been used to package bread products to try to prevent bread products from becoming stale. This, however, has been met with limited success. Paper bags tend to be difficult to seal and therefore allow the atmosphere to contact the bread products. Plastic bags have the advantage of being air tight but can and are easily torn through daily use of entering and resealing the bag. Thus, the advantage of plastic bags is limited.

As with many household foodstuffs, bread products are open to attack from household vermin, such as rats, mice, cockroaches and weevils. However, bread products seem to be more inclined to be eaten by these vermin than most other products. The present solution has been to place the bread products in solid wall containers commonly known as bread boxes. This works well in that typically it keeps household vermin from eating the bread products. These bread boxes are usually large and unsightly and take up substantial space in the kitchen area. Bread boxes usually are not air tight and therefore the bread products must be sealed before they are placed in the box.

The consumption of bread products is a normal every day occurrence for the normal family. Individuals in the family usually eat bread at various intervals during the normal day. Each person, to remove the desired amount of bread products, has to unseal the bag, pick up the bread products and reseal the bag. This results in the bread products quickly becoming stale and the bread product that is not consumed by the individual removing the bread, is touched. If the person has not washed his or her hands this may allow disease to spread to the bread products especially in food outlets such as sandwich bars.

Bread containers which dispense bread slices are known. Examples are found in U.S. Pat. Nos. 4,905,869, 4,500,145 and 4,213,540. These bread dispensers are either positioned horizontally in which case a spring or other type of biasing member is required to push bread along the dispenser and to the outlet, the outlet typically being a pivoting door, or the container is upright with bread being dispensed from the top of the container which again requires a spring or pulley arrangement to push bread upwardly towards the dispenser.

OBJECT OF THE INVENTION

It is an object of the invention to provide an apparatus which may overcome the abovementioned disadvantages or provide the consumer with a useful or commercial choice.

In one form the invention resides in an apparatus for dispensing sliced bread comprising a rigid container body in which a plurality of bread slices can be placed, the container body being generally closed to prevent the bread from becoming stale and having an upper inlet to allow bread slices to be placed in the container body, the container body further having a generally open lower end through which bread slices can pass, a base assembly linearly moveable between a closed position where it closes the open lower end of the container body, and an open position where the base assembly is spaced from the open lower end to allow bread to be removed from the apparatus, the base assembly having a bread support platform which can support the lowermost slice of bread in the container body when the base assembly is in the closed and open positions, biasing means to naturally bias the base assembly into its closed position; and, separating means adjacent the lower end of the container body, and moveable between a retracted position where bread slices can move past the separating means and into the base assembly and an extended position where such movement is prevented, the separating means being moved between its said positions upon movement of the base assembly.

The apparatus is simple to use in that there is no requirement for pulleys or springs to push the bread through the dispensing outlet. Also, by having the separating means operatively actuated upon opening or closing the base assembly, bread can be dispensed in a one-handed manner simply by pulling open the base assembly. The base assembly can move in a linear fashion and need not pivot about an axis, which allows the base assembly to form a bread support platform where bread can be easily removed by a person once the base assembly is pulled open.

The base assembly may have a base wall which can comprise the bread support platform and may also have at least one upstanding side wall. The upstanding side wall can slide relative to the container body as the base assembly moves between its open and closed position. The base wall may have a pair of upstanding side walls and these may be positioned adjacent opposed edges of the base wall and configured such that the pair of side walls can slide relative to opposed walls of the container body.

To provide a neat appearance and also for possible hygiene purposes, the container body may have an inner wall and an outer wall, the inner wall and outer wall being spaced apart to define a passage therebetween. The or each side wall of the base assembly may pass into the passage defined between the inner and outer side walls of the container body. In this manner, the side walls are hidden from view and there is a reduced tendency for the side walls to be damaged, become clogged with debris, dust, grime and the like. The bread support platform may comprise a tray positioned within the base assembly. The tray may be moveable relative to the base assembly, that is the tray may be height adjustable relative to the base assembly. This may be achieved by adjustment means which may be in the form of an adjustment screw which, upon actuation, will adjust the height of the platform relative to the base assembly. This arrangement can compensate for bread slices of different thicknesses.

The separating means may comprise at least one blade which can extend between opposed walls of the container body. The or each blade may be reciprocately moveable between its extended and retracted positions. Preferably, a pair of blades are provided, one on each side of the container, the blades being moveable towards and away from each other. To reduce snagging of the blade against a bread slice, and/or to reduce possible damage to the bread, the leading edge of each blade may be bevelled, rounded or otherwise profiled to increase its efficiency.

The or each blade may extend from and retract at least partially into a housing, and it is preferred that in the retracted position, the or each blade is almost totally retracted into its housing.

The or each side wall on the base assembly can be operatively attached to the biasing means, and the biasing means can be operatively attached to the container body to naturally bias the base assembly into the closed position. A suitable type of biasing means comprises a spring, although other biasing means such as resilient rubber and the like members are also envisaged. In another alternative, a thin strip of spring steel which unrolls and rolls up can be used to provide the biasing force. To provide a smooth opening and closing action of the base assembly, there may be provided more than one biasing means on each side wall, and suitably two biasing means such as springs are provided on each side wall. The biasing means may locate within the passage defined between the inner and outer wall of the container body and may be positioned in an upper portion thereof.

In order to keep sliced bread as fresh as possible in the container body, there may be provided a partition member which can be slidably moveable within the container body and can be adapted to be positioned on top of the bread slices. The partition body can thus slide down as bread is dispensed from the apparatus, and can be removed to allow new bread to be inserted into the container body. As well as the slidable partition member, there may also be provided a lid member to overlie the upper inlet, and the lid member may comprise a hinged lid member.

To reduce the complexity of use of the apparatus, the separating means may be operatively associated with the base assembly such that linear movement of the base assembly causes the separating means to move between its extended and retracted position., This can be achieved by providing the or each side wall of the base assembly with an elongate slot into which ends of the or each separating means can move. The ends of the or each separating means may be configured to ride freely along the slot and roller bearings, low friction material, or any other type of means may be used to achieved this. The slot in the or each side wall may be configured such that sliding movement of the side wall relative to the container body causes the or each separating means to move between its retracted and extended positions. Of course it should be realised that other forms of attachment between the side wall and a separating means can be used. For instance, instead of a slot, there may be provided a recess, track, or other type of locating means to locate ends of the separating means.

The internal partition which can slide within the container body may be attached for sliding movement to the container body. This can be achieved by providing the inside wall of the container body, and the sliding partition with one or more projections and recesses which can co-operate with each other. For instance, the sliding partition may be formed with a rib which can pass into a longitudinal recess on the inside wall of the container. This arrangement ensures a smooth sliding motion of the partition without appreciable pivoting or rocking.

BRIEF DESCRIPTION OF THE DRAWINGS

An embodiment of the invention will be illustrated with reference to the accompanying drawings in which.

BEST MODE

Figure 1:
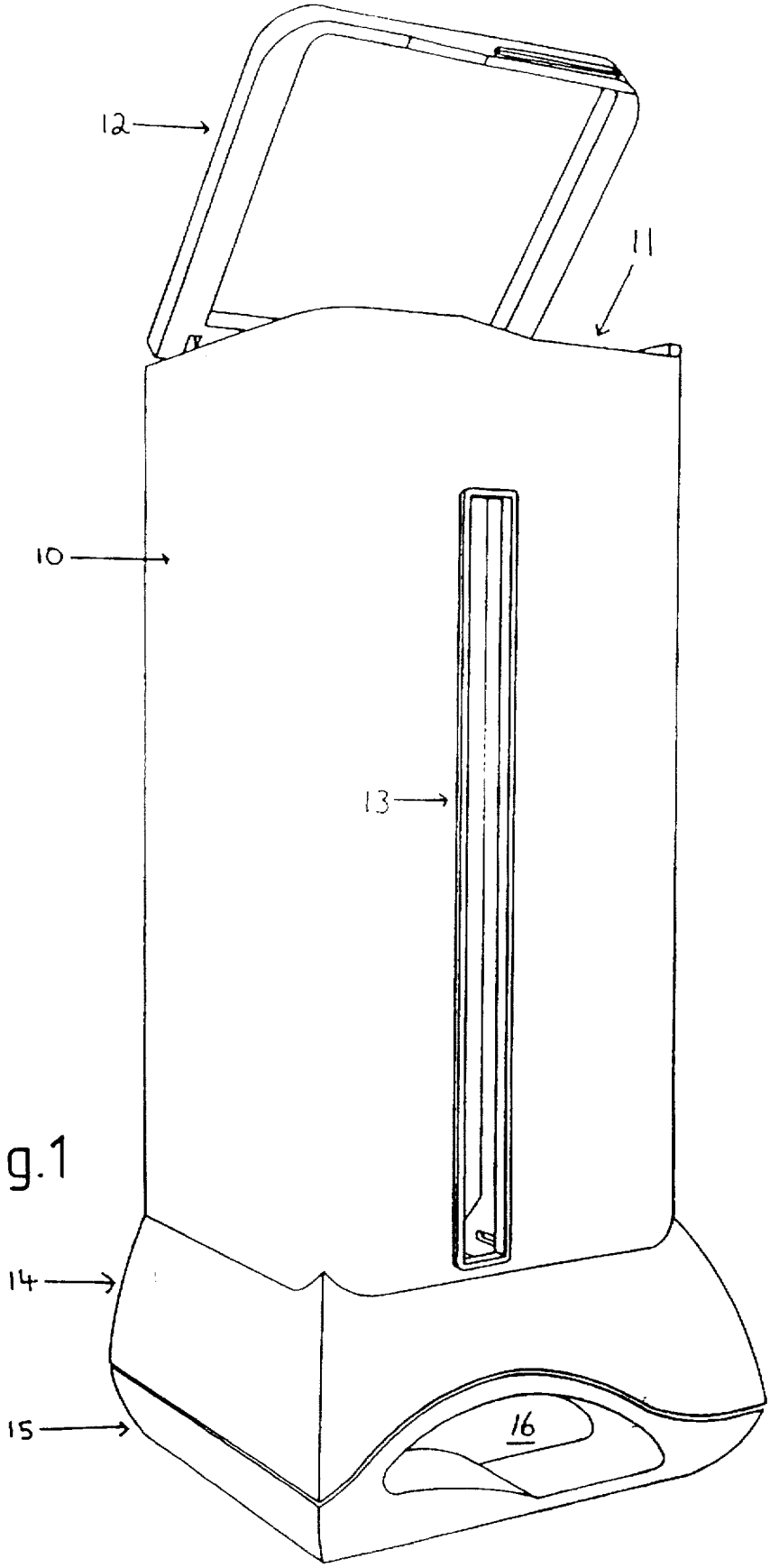
FIG. 1 is an overall view of an apparatus for dispensing sliced bread.

Referring to the figures and initially to FIG. 1, there is illustrated an apparatus for dispensing sliced bread. The apparatus has a container body 10 which can be formed from plastics, and which is substantially hollow. The container body 10 can be of any shape, but it is preferred that the shape is approximately square or rectangular to conform with the shape of sliced bread. The top of container body 10 has an inlet 11 through which sliced bread can pass to fill the inside of the container body 10. Inlet 11 can be closed with a pivoting lid 12. A viewing slot 13 can be provided on a front wall of the container body so that the number of bread slices within the container body can be readily established. Viewing slot 13 may have a glass or clear plastic front to minimise air circulation through the inside of container body 10 and also to prevent contamination of the bread slices.

Container body 10 is rigid in construction and is generally closed to prevent bread from becoming stale. Container body 10 has a generally open lower end 14 which is associated with a base assembly 15. Base assembly 15 is also formed from plastic material, and can be pulled in a linear manner between a closed position illustrated in FIG. 1 where it closes the open end of the container body 10, and an open position illustrated in FIGS. 2, 3 and 6 where the base assembly is spaced below the open lower end 14 of container body 10, and where bread can now be removed from the container body. A handle 16 is provided on the front wall of base assembly 15, and handle 16 is in the form or an ergonomically designed recess into which a person's fingers can pass to pull-down base assembly relative to container body 10.

Figure 2:
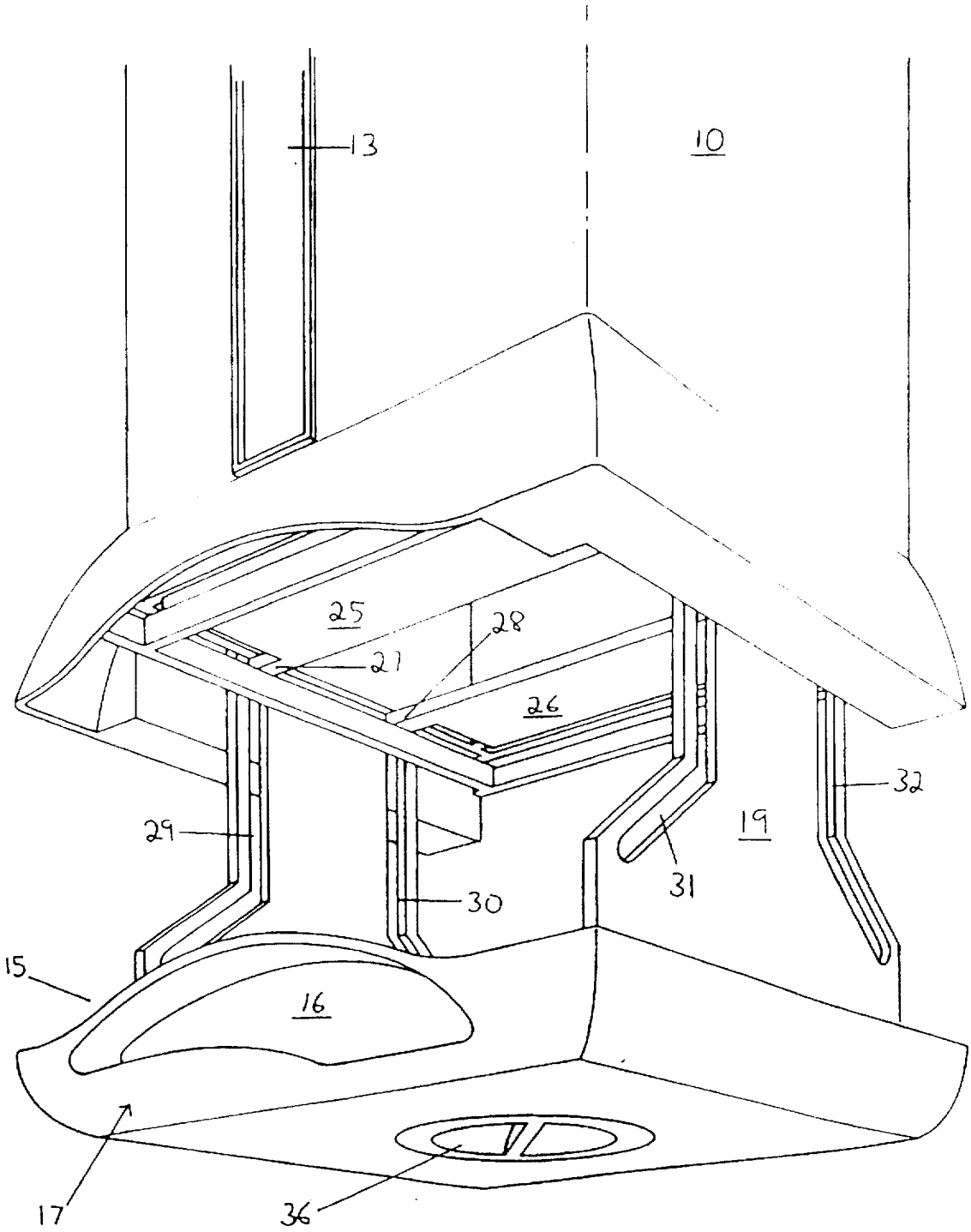
FIG. 2 shows a lower portion of the apparatus of FIG. 1 with the base assembly in a pull-down open position.

Referring to FIG. 2, there is illustrated in greater detail the components of base assembly 15. Base assembly 15 has a generally dish-shaped bottom wall 17. The front portion of bottom wall 17 having handle 16. Extending from opposed sides of bottom wall 17 are a pair of generally identically shaped rigid plastic side walls 18, 19. Side walls 18, 19 extend upwardly at right angles from bottom wall 17 and are spaced apart by sufficient distance to allow a slice of bread to be positioned on bottom wall 17 and between side walls 18, 19.

Figure 3:
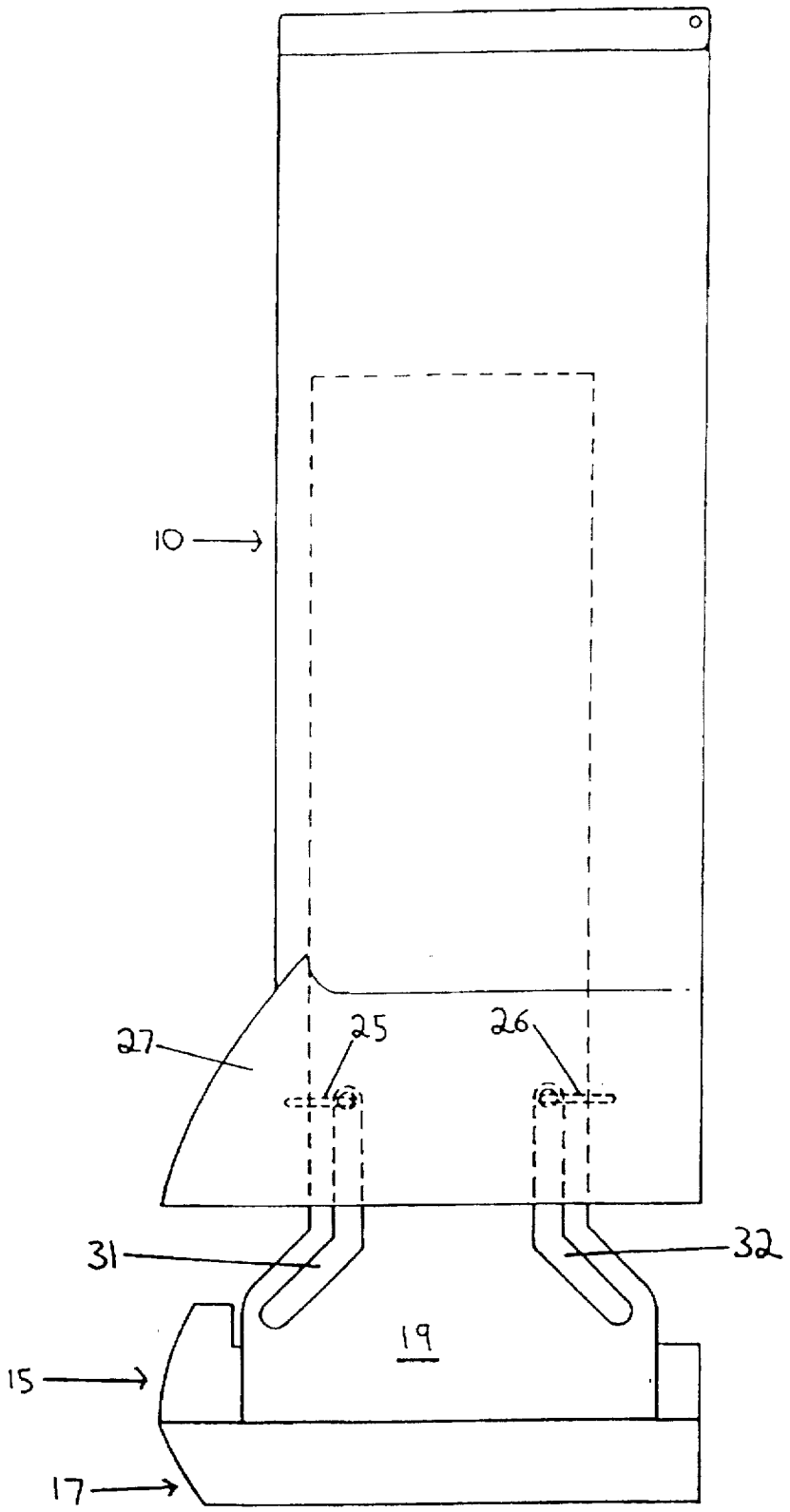
FIG. 3 is a side partially sectioned view of the apparatus of FIG. 1.
Figure 6:
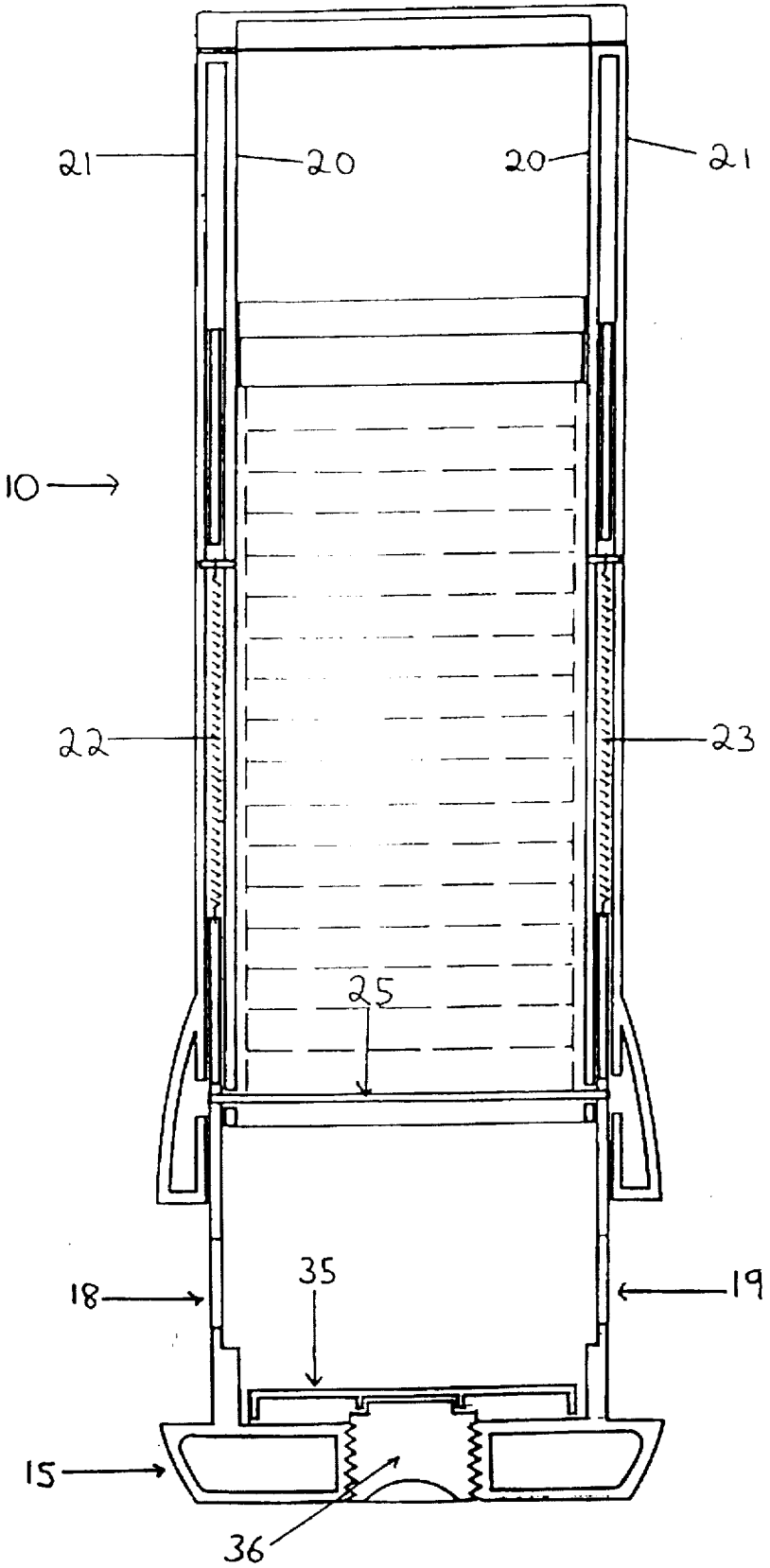
FIG. 6 is a section view of the dispenser of FIG. 1.

As illustrated in FIG. 6, container body 10 has an inner wall 20 and an outer wall 21, the walls being spaced apart sufficiently to allow side walls 18, 19 to pass into the passageway defined between inner and outer walls 20, 21. This is illustrated in FIGS. 2, 3, and 6 and results in an attractive looking apparatus, but also functions to prevent damage to the side walls, build-up of debris and contamination of the side walls, it being appreciated that the side walls are closely spaced from the bread slice to be dispensed.

Base assembly 15 is naturally biased to adopt a closed position as illustrated in FIG. 1 and must be pulled down against the bias to the open position illustrated in FIG. 2. Biasing of the base assembly is achieved by biasing means in the form of springs 22, 23 better illustrated in FIG. 6. Springs 22, 23 are attached to an upper portion of each side wall 18, 19 and are also attached to an upper portion of container body 10. The springs are also designed to locate within the spacing between inner wall 20 and outer wall 21 which again serves to prevent damage, snagging, contamination or corrosion of the springs. The springs 22, 23 and side walls 18, 19 are also kept away from direct contact with bread slices by being positioned between inner wall 20 and outer wall 21. To ensure a smooth opening and closing action of base assembly 15, it is preferred that two springs are provided for each side wall, the springs being spaced apart such that a constant biasing action is provided.

Figure 4A:
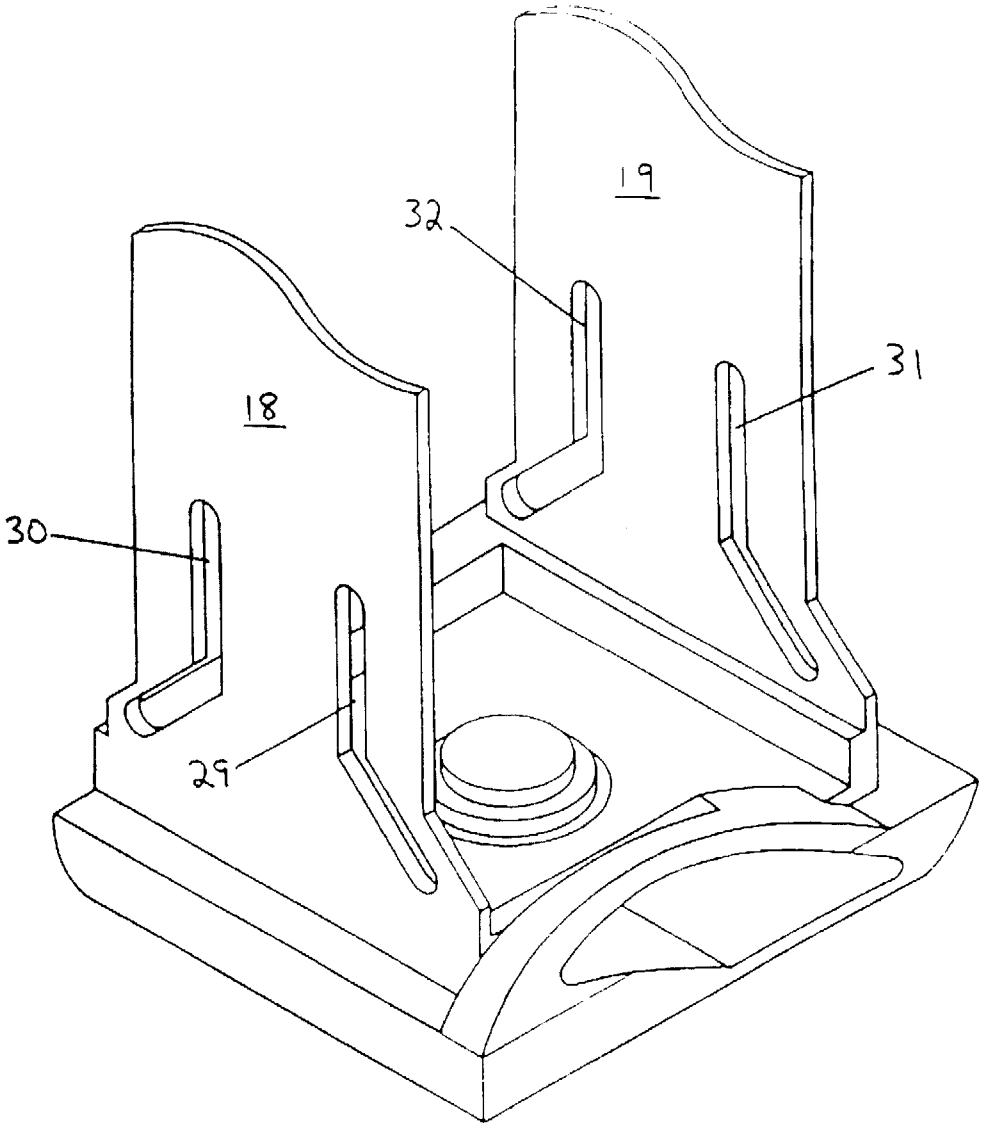
FIGS. 4*a* and 4*b* show a lower portion of the base assembly.
Figure 4B:
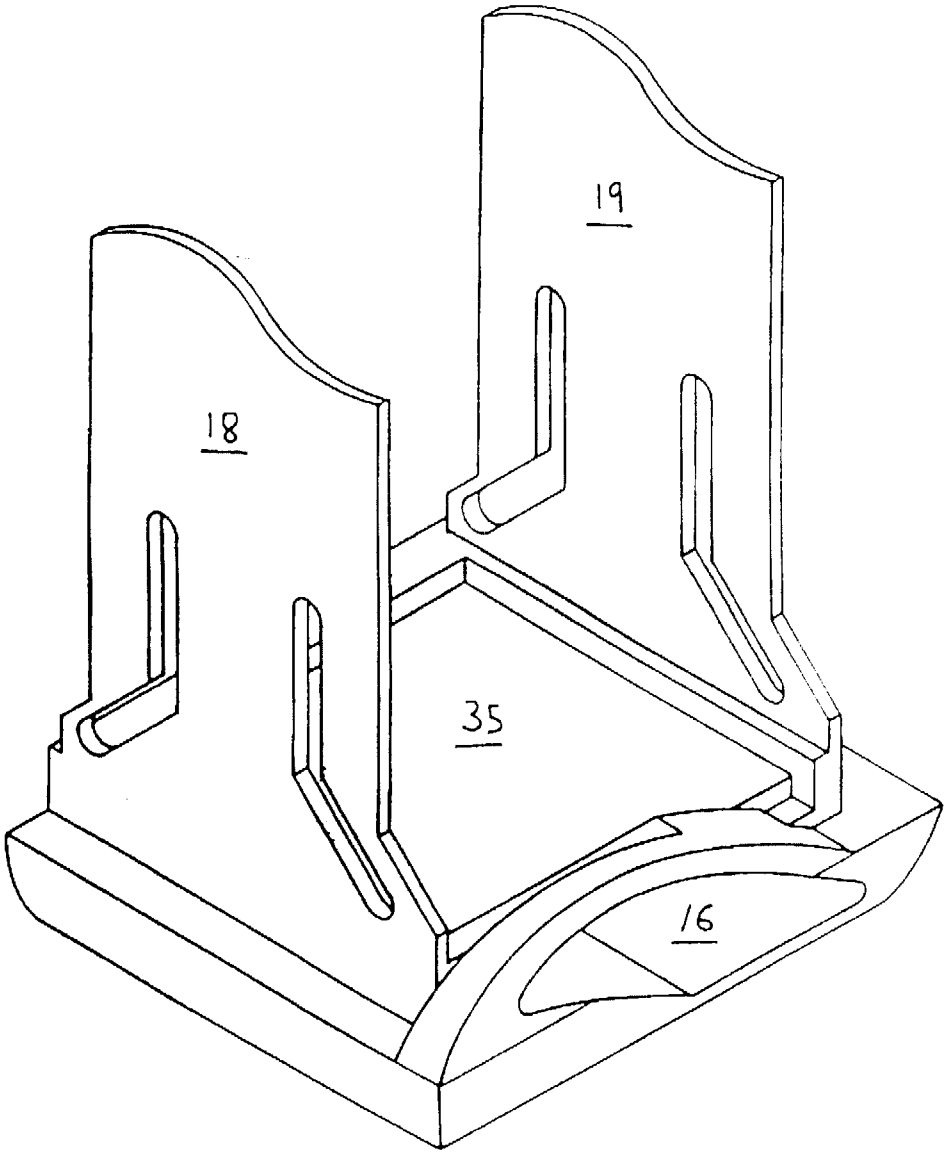

In order to prevent more than the required slices of bread from passing into base assembly 15 when base assembly 15 is pulled down, there are provided separating means to hold back the unneeded slices of bread. The separating means comprise a pair of blades 25, 26 which are illustrated in FIGS. 2 and 3. Blades 25, 26 comprise rectangular flat plastic members which extend between opposed side walls of container body 10. Blades 25, 26 can reciprocate between an extended bread holding position (illustrated in FIG. 2) and a retracted position where sliced bread can pass along container body 10 past blades 25, 26 and onto base assembly 15. Blades 25, 26 extend into and from a housing 27 illustrated in FIG. 3. Each blade 25, 26 has opposed edges which have a nose portion or other type of projection 27, 28 which is captured by slots 29–32 on side walls 18, 19. Each side wall 18, 19 has two slots as illustrated in FIGS. 2 and 4 the slots being V-shaped in configuration.

This arrangement of slots on side walls 18, 19 which capture edges of blades 25, 26 operatively connect the separating means to the base assembly such that opening and closing of the base assembly causes outward and inward movement of blades 25, 26. For example, when base assembly 15 is in the upper closed position, blades 25, 26 are retracted into their housing and nose portions 27, 28 are positioned at the lowermost portion of each of slots 29–32. As base assembly 15 is pulled down, the nose portions will ride along the slots and, as the initial part of the slot is angled relative to the direction of pull-down of the base assembly 15, blades 25, 26 will be moved to their extended position. Further pulling down of the base assembly will not cause further movement of blades 25, 26 as the slot is not vertical, that is in line with the direction of pull-down of the base assembly. When the base assembly is released and the springs pull the base assembly back to its closed position, the reverse procedure takes place and blades 25, 26 will be retracted back into their respective housings.

The spacing between the bottom of base assembly 15 and blades 25, 26 is such that when the base assembly is in the closed position as illustrated in FIG. 1, and therefore blades 25, 26 are fully retracted, only a discreet number of bread slices, typically one to two slices, fall between blades 25, 26 and the bottom of base assembly 15. Thus, when base assembly 15 is subsequently pulled open, blades 25, 26 extend into their extended position and will hold back any additional slices of bread. Thus, the user is presented with one or two slices of bread in base assembly 15, which can then be removed.

The number of bread slices can be varied and this can be achieved by adjusting the spacing between the bottom of base assembly 15 and blades 25, 26. FIG. 6 illustrates how this can be achieved. In FIG. 6, base assembly 15 has a bread supporting platform 35 which sits within base assembly 15. Bread support platform 35 is connected to an adjustment screw 36 which is also illustrated in FIG. 2 which can be turned to adjust the height of bread support platform 35 relative to blades 25, 26. If desired, additional spacing plates or disks can also be placed on top of platform 35.

Figure 5:
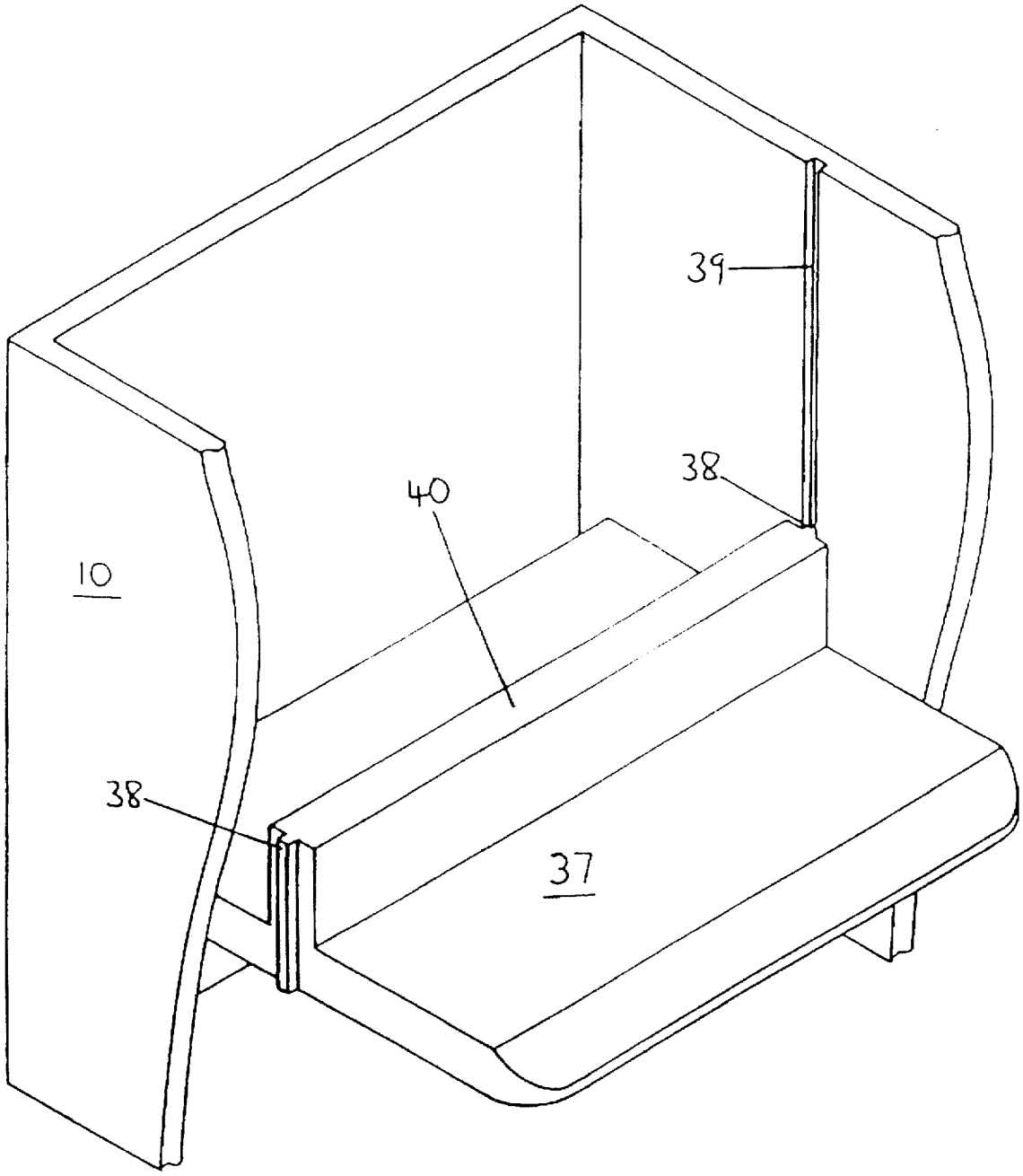
FIG. 5 shows a part section of the inside of the container body having a slidable partition.

To keep the top of the bread stack fresh in container body 10, there is provided a sliding partition 37 which is illustrated in FIG. 5. Sliding partition 37 is dimensioned to slide within container body 10 and on top of the stack of bread. As bread is dispensed through base assembly 15, sliding partition 37 slides down along container body to keep the bread fresh. To prevent uneven movement of sliding member 37 (rocking can cause it to stick), edges of sliding member 37 are provided with ribs 38 which pass into slots 39 on the inside wall of container body 10. A handle 40 is provided on top of sliding member 37 such that sliding member 37 can be readily removed from container body 10 to allow new bread to be inserted within the container body.

It should be appreciated that various other changes and modifications can be made to the embodiment described. For instance, blades 25, 26 can be connected into slots 29–32 through roller bearings. Additionally, to prevent rocking of blades 25, 26 the nose portions may be positioned centrally along each edge.

In order to accommodate bread slices of larger and small cross-section sizes, the apparatus may be sized to accommodate the larger slices of bread. For small slices of bread, an internal sleeve is inserted into the container body, the internal sleeve being sized to accommodate the smaller bread slices. The internal sleeve will have a sliding partition similar to partition 37 shown in FIG. 5. The sleeve can be removed from the container body if it is desired to use the larger bread slices.

I claim:

1. An apparatus for dispensing sliced bread comprising a rigid container body in which a plurality of bread slices can be placed, the container body being generally closed to prevent the bread from becoming stale and having an upper inlet to allow bread slices to be placed in the container body, the container body further having a generally open lower end through which bread slices can pass, a base assembly linearly moveable between a closed position where it closes the open lower end of the container body, and an open position where the base assembly is spaced from the open lower end to allow bread to be removed from the apparatus, the base assembly having a bread support platform which can support the lowermost slice of bread in the container body when the base assembly is in the closed and open positions, biasing means to naturally bias the base assembly into its closed position; and, separating means adjacent the lower end of the container body, and moveable between a retracted position where bread slices can move past the separating means and into the base assembly and an extended position where such movement is prevented, the separating means being moved between its said positions upon movement of the base assembly.

2. The apparatus of claim 1 wherein the base assembly has a base wall comprising the bread support platform and at least one upstanding side wall which is adapted to slide relative to the container body as the base assembly moves between its positions.

3. The apparatus of claim 2, wherein the container body has an inner wall and an outer wall which are spaced apart by a distance sufficient to allow the said side wall to pass between the inner and outer walls.

4. The apparatus of claim 3, wherein a pair of side walls are provided extending from opposed edges of the base wall.

5. The apparatus of claim 4, wherein each side wall is operatively attached to at least one biasing means, the biasing means being a spring located between the outer wall and the inner wall.

6. The apparatus of claim 3, wherein the separating means comprises at least one blade extending between opposed walls of the container body, the blade being reciprocately moveable between its extended and retracted positions.

7. The apparatus of claim 6, wherein the blade locates at least partially in a housing when in the retracted position.

8. The apparatus of claim 6 comprising a pair of said blades adjacent opposed side walls of the container body.

9. The apparatus of claim 2, wherein the at least one upstanding side wall is operatively attached to the biasing means, the biasing means being operatively attached to the container body.

10. The apparatus of claim 9, wherein the biasing means is a spring.

11. The apparatus of claim 2 wherein the separating means is operatively connected to the side wall such that sliding movement of the side wall causes the separating means to move between its positions.

12. The apparatus of claim 11, wherein movement of the base assembly towards its open position causes the separating means to move to its extended position.

13. The apparatus of claim 12, wherein the side wall is provided with an elongate slot having a V configuration and the separating means has opposed ends which extend into the slot and which ends can move along the slot to move the separating means between its positions upon movement of the side wall.

14. The apparatus of claim 1 including a partition member slidably moveable within the container body and adapted to be positioned on top of the bread slices to reduce contact of the bread with air.

15. The apparatus of claim 1 wherein the bread support platform is a tray positioned within the base assembly, the height of the tray being adjustable to accommodate different thicknesses of bread to be dispensed.

* * * * *